US005730708A

United States Patent [19]

Spratt

[11] Patent Number: 5,730,708

[45] Date of Patent: Mar. 24, 1998

[54] MULTI DIRECTIONAL MASSAGER

[76] Inventor: Todd Spratt, P.O. Box 151, Rough & Ready, Calif. 95975

[21] Appl. No.: 509,388

[22] Filed: Jul. 31, 1995

[51] Int. Cl.[6] ..... A61H 15/00

[52] U.S. Cl. ..... 601/118; 601/135

[58] Field of Search ..... 601/118, 119, 601/129, 133, 134, 135

[56] References Cited

U.S. PATENT DOCUMENTS

| | | | |
|---|---|---|---|
| 1,086,936 | 2/1914 | Pouder et al. | 601/119 |
| 2,307,554 | 1/1943 | Wettlauter | 601/120 |
| 3,856,002 | 12/1974 | Matsumoto | 128/67 |
| 4,266,536 | 5/1981 | Casares | 128/57 |
| 4,411,421 | 10/1983 | Hershberger | 272/73 |
| 4,493,315 | 1/1985 | Iwahashi | 128/67 |
| 4,944,747 | 7/1990 | Newth et al. | 606/204 |
| 5,143,057 | 9/1992 | DePasquale | 601/135 |
| 5,405,311 | 4/1995 | Pecora et al. | 601/135 |
| 5,492,526 | 2/1996 | Chen | 601/118 |

*Primary Examiner*—Max Hindenburg
*Assistant Examiner*—Pamela L. Wingood

[57] ABSTRACT

A massager for the back portion of the human body having two identical handlebars (20) in an arched configuration. One end of each handlebar being flattened and hinged to each end of a rolling dual ended pivot (14) in such a way that handlebars (20) form an oval when free ends meet. Handlebars (20) having a length and arch such that they encompass a human torso when free ends meet. Cylindrically shaped pivot having bumper pad (16) cover. One or more massage members (8) are removably secured by retaining knobs (18) to the inside of arched handlebars (20) closer to the hinged ends thereof. Retaining knobs (18) protrude through a plurality of adjustment holes (10) in handlebar (20) and thread into female threaded massage members (8).

10 Claims, 3 Drawing Sheets

MULTI DIRECTIONAL MASSAGER

BACKGROUND

1. Field of the Invention

This invention relates to manually operated massage devises, specifically to such massage devises which are used for massaging the back portion of the human body.

2. Description of Prior Art

People have for centuries recognized the benefits of massage for relieving muscle pain and stiffness in the human body, especially the hard to reach back portion. The need for relief of back pain seems to have escalated in recent years with no end in sight.

Relief of muscle pain in the back generally requires foreign assistance of some form. Originally, this was accomplished by means of a masseuse or massage therapist, however, with any massage therapy, it is temporary relief and repeated use of a professional is expensive and time consuming. Whirlpool spas are another form of pain relief but are of large size, weight and are expensive to purchase, operate and maintain.

Several types of user operated manual massage devises have been developed. Although they eliminate the need for electricity, and can be produced less expensively than motorized massage devises, they are limited by a number of disadvantages. U.S. Pat. No. 3,856,002 to Matsumoto (1974) is limited to a single massage head, direct pressure or rubbing massage, and the user must pull the massage head into the muscle tissue which tightens the muscles. U.S. Pat. No. 4,266,536 to Casares (1981) eliminates the need to pull massage roller into muscle tissue but is restricted to a single massage roller and an up and down direction.

Although U.S. Pat. No. 4,411,421 to Hershberger (1983) utilizes two independent massage rollers and allows the user to rest against them, it too is limited to an up and down motion, will only cover a portion of the back, and is bulky requiring a large area for use and storage.

Prior art that utilize different techniques of massage are disclosed in U.S. Pat. No. 4,493,315 to Iwahashi (1985) and U.S. Pat. No. 4,944,747 to Newth et al. (1990). The Iwahashi devise performs a kneading massage or finger pressure, and is limited to that technique. The rigid hand bar design also requires ackward positioning of the arms to grasp and operate behind the shoulder and just below the armpits. Both the Iwahashi and Newth devises require the user to pull the massage members into the muscle tissue which tightens the muscle tissue that the user is attempting to relax. The resilient material used in Iwahashi's devise adds additional resistance during use. The use of rope and strap material for extension of the handles also limits the controllability while in use. All of the manually operated massage devises heretofore known suffer from a number of disadvantages:

(a) The use of a single massage head or roller reduces the area massaged. This requires more time to massage the same area that two or more massage heads or rollers would massage.

(b) A massage devise utilizing rigid hand bars are difficult to grasp and operate, especially behind the shoulders and just below the armpits.

(c) The massager is limited to a single massage technique, and direction during use.

(d) The design of the apparatus is bulky, requiring large spaces for operation and storage.

(e) Certain massage apparatus will only massage a limited portion of the human back.

(f) Many of the massage devises require the use to pull the massage members into the muscle tissue. This pulling action tightens the very muscle tissue that the user is attempting to relax.

(g) If one uses rope or strap materials as a handle extension attached to a massage devise, there is loss of control during operation. This is evident by the limber nature of ropes and straps.

Objects and Advantages

Accordingly, in addition to the advantages of massage therapy, several objects and advantages of the present invention are:

(a) to provide a massager with the ability to utilize two or more massage members, enabling the user to massage a greater area in less time.

(b) to provide a massager with two handle bars that curve around the human body, allowing easy operation directly in front of the user.

(c) to provide a massager that will produce a variety of massage techniques, directions and speeds of movement.

(d) to provide a massager that is simple, compact, and inexpensive to manufacture.

(e) to provide a massager with the ability to massage the entire back portion of the human body.

(f) to provide a massager with handlebars that eliminate the need for limp rope and strap materials.

(g) to provide a massager with which the individual can rest against while using, to apply the desired amount of massage pressure, eliminating the need to pull.

(h) to provide a massager that utilizes a roll dual ended pivotal hinge member, eliminating resistance associated with resilient materials, used in moving parts.

Furthermore, other advantages would be to provide massage therapy when and where one might need it, at a desired amount of massage pressure and with out stressing muscle tissue, with resistance free moving parts, that can massage the entire back portion of the human body, with several different massage techniques, that is lightweight, easy to operate and inexpensive to manufacture. Still further object and advantages will become apparent from review of the ensuing descriptions and drawings.

DRAWING FIGURES

In the drawings, operation figures have the same numbers with different alphabetic suffixes.

REFERENCE NUMERALS IN DRAWINGS

8 massage members 10 adjustment holes

Figure 1:
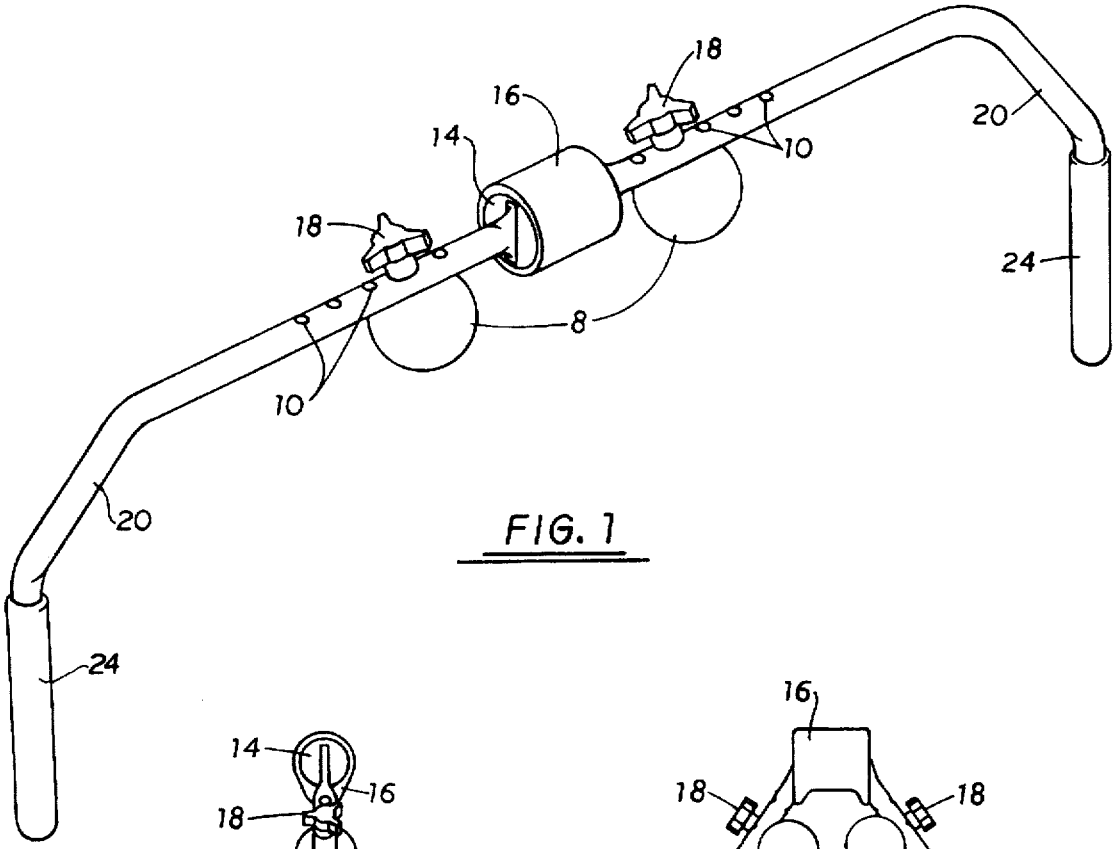
FIG. 1 shows the massager with handlebars fully extended.

12 hinge pin 14 rolling dual ended pivot

16 bumper pad 18 retaining knob

20 handlebar 22 threaded insert

24 handgrip

DESCRIPTION—FIGS. 1 TO 6

Figure 2:
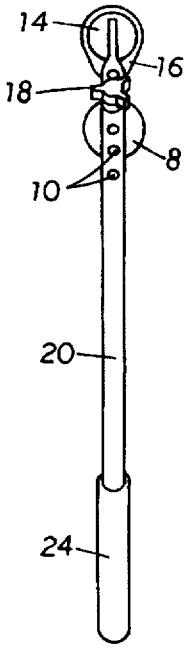
FIG. 2 shows a side view of the massager.
Figure 3:
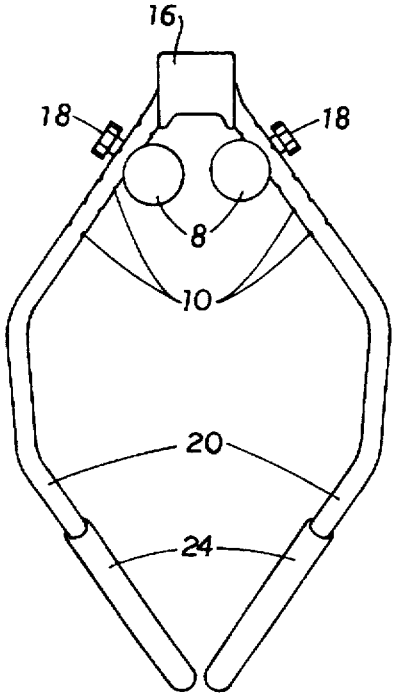
FIG. 3 shows a front view of the massager with handlebars in a closed position.

A typical embodiment of the massager of the present invention is illustrated in FIG. 1 (prospective view) FIG. 2 (side view) and FIG. 3 (front view). The massager has two identical handlebars 20 having an arched configuration. One end of handlebar 20 is pressed flat, with the length of flattened area equal to the width. The flattened area is parallel to a horizontal surface when handlebar 20 is resting freely on surface. A hole slightly larger than hinge pin 12 (shown in FIG. 5) is punched through center of flattened area. Starting from flattened end, the handlebar extends one third of its length straight before beginning of the arch. Handlebars 20 having such a length that when joined at all ends they encompass a human torso (approx. 1 meter). Beginning from flattened end of handlebar 20 a plurality of adjustment holes 10 are punched through handlebar 20. Adjustment holes 10 are punched parallel with flattened area. In the preferred embodiment handlebars 20 are made of aluminum tubing. However, the handlebars can be composed of metals, plastics such as pvc, polypropylene, ABS, acetal, wood, etc.

Flattened ends of handlebars 20 are hinged to a rolling dual ended pivot 14. This allows opposite ends of handlebars to swing away from each other, as shown in FIG. 1. Then back toward each other forming roughly an oval (shown in FIG. 3). Pivot 14 has a cylindrical shape. Handlebars 20 are hinged to pivot 14 near the ends of pivot 14. A bumper pad 16 is slid over pivot 14 concealing it while protecting walls and vertebra. Bumper pad 16 is a tube shape having a slightly smaller inner dimension than the outer dimension of pivot 14. In the preferred embodiment bumper pad consist of acrylonitrile/pvc blend, but could also be made of foam rubber, neoprene, polyurethane, rubber, cloth, etc.

A handgrip 24 is placed over the loose ends of handlebar 20, providing a comfortable grip. Handgrip 24 is a tube comprised of the same materials as bumper pad 16. Handgrip 24 having an inner dimension slightly smaller than outer dimension of handlebar 20. The length of handgrip 24 is approximately one fourth the length of handlebar 20. One end of handgrip 24 is sealed closed, to act as a cap.

Retaining knob 18 is inserted through adjustment hole 10 to secure massage member 8 to handlebar 20. Knob 18 is made of plastic with a threaded metal stud protruding from knob 18. Metal stud having an outer dimension slightly smaller than inner dimension of adjustment holes 10.

Figure 4:
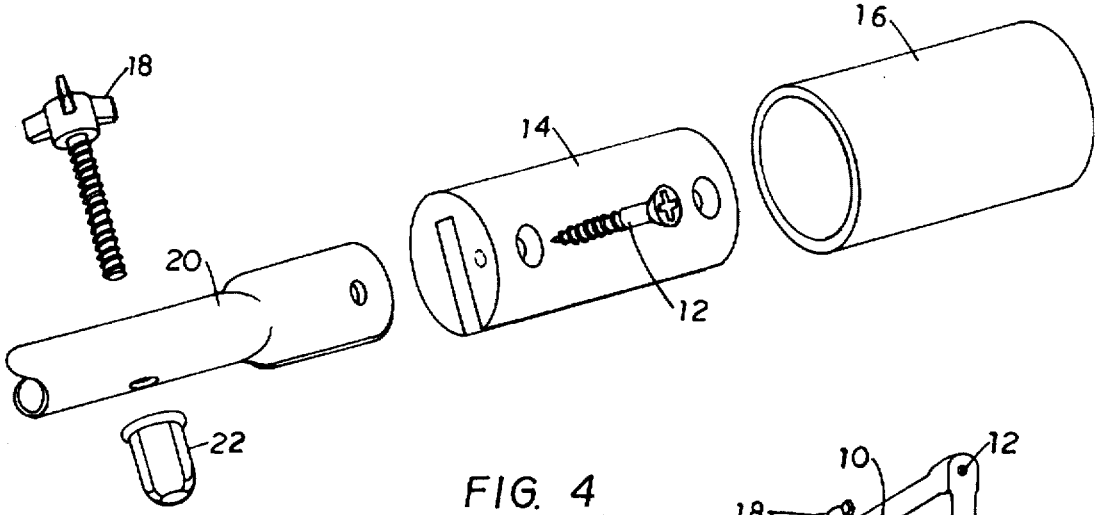
FIG. 4 shows an exploded view of the rolling dual ended pivot and massage members.

FIG. 4 displays an exploded view of the rolling dual ended pivot 14 and massage member 8 assembly. Pivot 14 having a cylindrical shape with a slot extending the length of pivot 14. The width of the slot is equal the thickness of flattened area on handlebar 20. Slot extends two thirds of the way into the center of the diameter of pivot 14, and equals the width of flattened area of handlebar 20. Two holes are bored through pivot 14 in a direction perpendicular to slot. Holes are in line with hole in flattened area of handlebar 20 when inserted completely into end of slot. When holes are in line, a hinge pin 12 is threaded in, creating a hinge for handlebars 20. Bumper pad 16 is slid over pivot 14. In the preferred embodiment pivot 14 is made of polypropylene or other plastic, but may also consist of nylon, hardened rubber, metal, alloys, wood, etc.

A thread insert 22 is bonded with epoxy into a hole bored in massage member 8. Insert 22 having fins to prevent spinning in massage member 8. Insert is composed of nylon, but a number of alternative materials can be used. Retaining knob 18 inserts through adjustment hole 10 and threads into insert 22 securing massage member 8 to handlebar 20 thus providing a means for a softer material to be used for massage member 8 by allowing retaining knob 18 to be turned and tightened and not a soft massage member 8. In FIG. 4 the massage member 8 is a ball the approximate size of a tennis ball. Its size, shape, and texture can be modified for different massage techniques. The preferred material for massage member 8 is sponge rubber, but can also consist of foam rubber, neoprene, plastic, metal, cloth, wood, etc.

Figure 5:
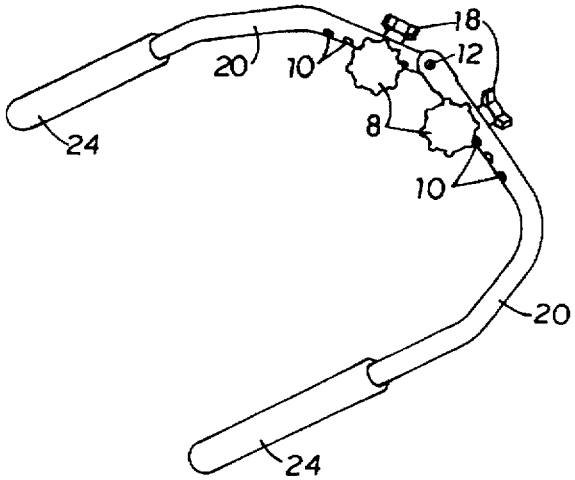
FIG. 5 shows a massager with handlebars partially open and lobed massage members.

FIG. 5 illustrates a massager without a pivot 14. Handlebars 20 are connected flattened end to flattened end by hinge pin 12. Handlebars 20 are partially open with lobed massaged members 8 attached.

Figure 6:
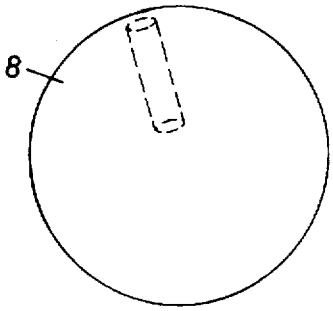
FIG. 6 shows a massager with handlebars closed and four massage members.
Figure 6:
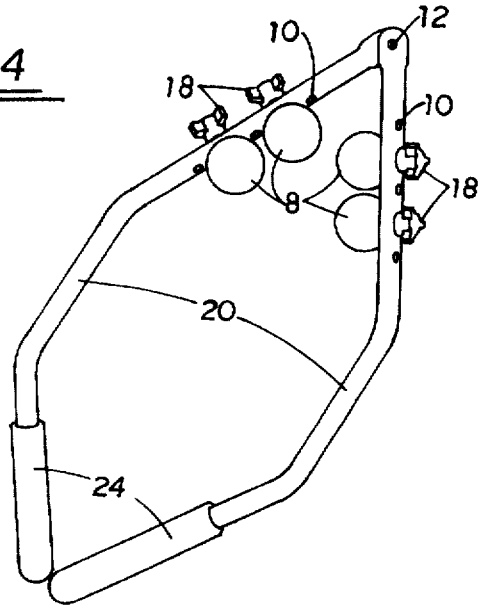

FIG. 6 shows the same massager as in FIG. 5, with handlebars 20 in the closed position. There are four massage members 8 attached to handlebars 20 in FIG. 6.

After review of the above description a number of advantages of the multi directional massager become evident.

(a) The bumper pad protects walls and vertabra, while allowing the user to lean against massage members, this enables the user to apply a desired massage pressure without pulling on handlebars.

(b) The rolling dual ended pivot enables the user to apply the amount of massage pressure and motion desired by placing the padded rolling pivot against a stationary surface i.e. wall and then leaning the back portion of the body against the massage members while holding the handlebars in front of the body, movement of the handlebars and massage members longitudinally is allowed by the rolling action of the rolling pivot while simultaneous lateral movement of handlebars and massage members is allowed by the hinge pins connecting the handlebars at each end of the rolling dual ended pivot making it possible to manipulate massage members in every direction.

(c) The arched configuration of the handlebars permit the user to comfortably crasp and operate massager in front of his or her body, eliminating ackward arm positions.

(d) The ability to attach two or more, as well as different styles of massage members, presents a diversity of massage techniques.

(e) The above described massager is comprised of lightweight, durable, and inexpensive materials. Parts involve simple manufacturing.

OPERATION—FIGS. 7A TO 7E

Figure 7B:
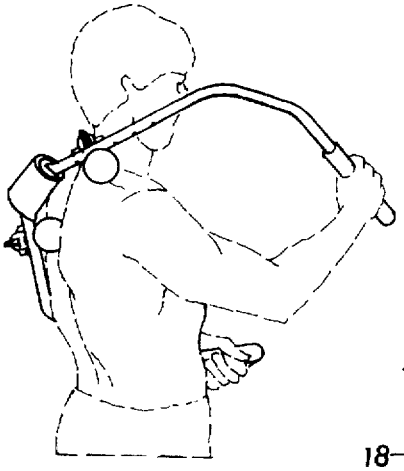
FIGS. 7A to 7E show various operational functions.
Figure 7C:
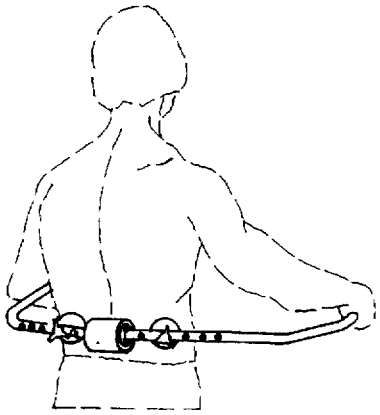
Figure 7A:
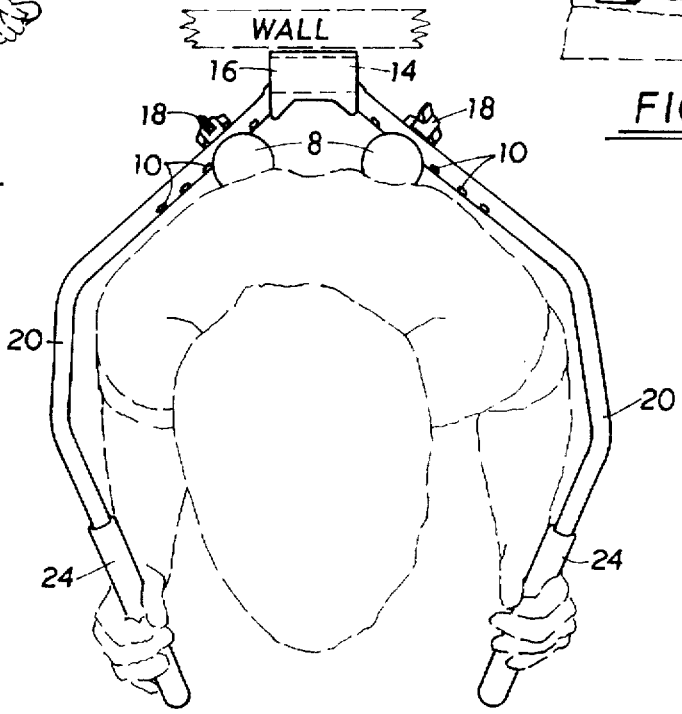

FIG. 7A shows a top view of the massager during operation. The male figure is massaging the shoulder blade area of his back adjacent to the spine, with massage members 8. While grasping handgrips 24 the user raises pivot 14 portion over his head and behind his back. Placing the massage members 8 on the area to be massaged, the user leans back and rests bumper pad 16 on a stationary vertical surface, in FIG. 7A that surface is a wall. Bumper pad 16 protects wall and spine, while concealed rolling pivot 4 allows handlebars 20 and massage members 8 to move vertically and horizontally. The user operates the massager from in front of his body while resting against massage members. A user may use many handlebar 20 movements to achieve different massage techniques. Moving handlebars 20 away from and then toward each other, while leaning at a greater degree results in a kneading massage. Leaning at a lesser degree with the same motion, an up and down motion or combination of motions, will create a rubbing massage. The user may simply find tight muscles and apply direct pressure or squeeze sore muscles with little or no movement.

FIG. 7B shows the male figure using the massager to knead and squeeze the trapezius muscle tissue. No wall is needed for this form of operation, the weight of the arm creates sufficient massage pressure.

FIG. 7C displays use of the massager on the lower back. A wall is useful for effective and relaxed operation of this form.

Figure 7D:
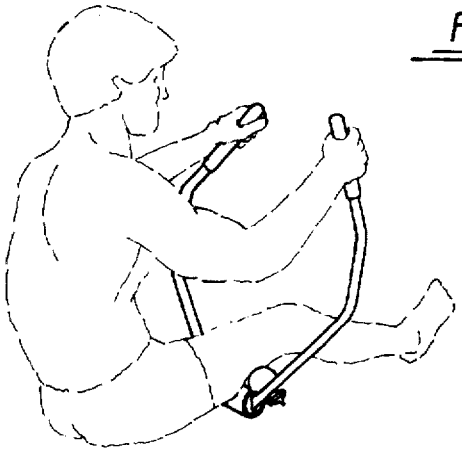

FIG. 7D shows the male figure sitting on a horizontal surface, resting his leg on massage members and massaging the hamstring muscle.

Figure 7E:
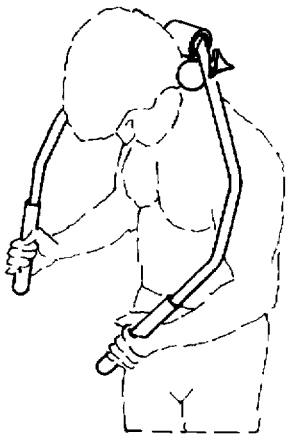

In FIG. 7E the back of the neck is massaged. Arm weight applies sufficient massage pressure.

SUMMARY, RAMIFICATION, AND SCOPE

Accordingly, the reader will see that this multi directional massager can be used to relieve stiffness and pain in the muscle tissue of the entire back portion of the human body, when and where the individual finds a need. In addition, it provides a wide range of movement and massage techniques, it is lightweight, compact, and easy to operate. Furthermore, this invention has the additional advantages of the following:

It permits the user to apply massage pressure by simply resting against the massager. This eliminates the stress created when having to pull to supply pressure.

It permits the use of leverage, due to the handlebar design and placement of massage members; thus enabling the user to apply a maximum squeezing force with a minimal amount of effort.

It permits the use of two or more massage members with a wide variety of designs and shapes.

It provides a resistant free rolling pivot assembly, eliminating the need for resilient materials which create resistance.

It provides wrap around handlebars for relaxed operation in front of the body.

It provides a bumper pad that protects walls, floors, and the spine while in use.

Although the above description contains many specifications, these should not be considered as limitations in the scope of the invention, but merely to provide an illustration of the presently preferred embodiments of this design. For example, the massager may have roller type massage members. It may also be used to massage muscles in the front of the body. Thus the scope of the invention should be determined by the appended claims and their legal equivalents, rather than by the examples given.

I claim:

1. A massager for the human body comprising a pair of identical handlebars having an arched configuration and pre-determined length, said handlebars are connected end to end of a rolling dual ended pivot means in such a way that said handlebars form an oval when free ends are met, a plurality of massage members equipped with female threads are removably secured to the inside of said arched handlebars closer to the connected ends in such a way that massage members move in a multitude of directions when handlebars are operated in a similar direction.

2. The massager of claim 1 wherein said rolling dual ended pivot having a cylindrical shape and pre-determined size, allows a rolling or rotating effect when used against a stationary surface while allowing said handlebars to swing freely in the opposite direction.

3. The massager of claim 2 wherein said rolling dual ended pivot includes a bumper pad composed of a cushion material that prevents massager from slipping on a stationary surface, while protecting said surface during use.

4. The massager of claim 1 wherein said handlebars having a length such that they encompass a human torso when free ends are joined, thereby facilitating use of the massager from in front of the body.

5. The massager of claim 1 wherein said massage members include a female threaded insert thereby allowing a retaining knob to be turned and tightened and not a soft massage member.

6. In a massager of the type comprising two handlebars with matching features having a pre-determined length in an arched shape, one end of each said handlebar is connected to a rolling dual ended pivot means so as to encircle a human torso when free ends are in contact allowing free ends of said handlebars to swing freely laterally while simultaneously moving in a longitudinal direction one or more massage members are secured to the inside of each arched handlebar closer to the connected ends by a retaining means, thereby manual movement of said handlebars activates movement of said massage members at user discretion.

7. The massager of claim 6 wherein said rolling dual ended pivot having a cylindrical shape with pre-determined diameter and length, one end of each said handlebar is attached closer to each end of the roller by a hinge pin, thereby allowing said handlebars to move in the opposite direction of pivot when used in conjunction with a stationary surface.

8. The massager of claim 7 further including a bumper pad comprising a cushion material with a tubular shape, to cover said rolling dual ended pivot to protect stationary surfaces and prevent massager from slipping while in use.

9. The massager of claim 1 wherein said handlebars having pre-determined length and arched configuration as to form an oval completely around a human torso, allowing maximum control during operation from in front of the body.

10. The massager of claim 1 wherein said massage members are equipped with a female threaded insert as to removably secure massage members to said handlebars with a retaining knob means.

* * * * *